United States Patent [19]

Morrison

[11] Patent Number: 4,662,855

[45] Date of Patent: May 5, 1987

[54] POP-UP CRIB TOY

[75] Inventor: Howard J. Morrison, Deerfield, Ill.

[73] Assignee: Marvin Glass & Associates, Chicago, Ill.

[21] Appl. No.: 814,011

[22] Filed: Dec. 20, 1985

Related U.S. Application Data

[63] Continuation of Ser. No. 685,983, Dec. 24, 1984, abandoned.

[51] Int. Cl.[4] ..... A63H 13/00

[52] U.S. Cl. ..... 446/227; 446/320; 446/353

[58] Field of Search ..... 446/227, 320, 338, 353, 446/352, 272, 275, 280, 281, 279, 287, 288, 308–310, 487, 489, 314, 268

[56] References Cited

U.S. PATENT DOCUMENTS

| | | | |
|---|---|---|---|
| 1,270,344 | 6/1918 | Terlecky | 446/280 |
| 1,683,561 | 9/1928 | Letson | 446/320 X |
| 1,886,442 | 11/1932 | Wimmer | 446/338 |
| 2,320,302 | 5/1943 | Robins | 446/309 |
| 2,668,391 | 2/1954 | Huard et al. | 446/287 |
| 3,290,817 | 12/1966 | Kravath | 446/227 |
| 3,457,671 | 7/1969 | Roth | 446/314 |
| 3,763,591 | 10/1973 | Fontana | 446/310 X |
| 4,209,938 | 7/1980 | Orenstein | 446/353 |
| 4,246,722 | 1/1981 | Sapkus et al. | 446/320 |

FOREIGN PATENT DOCUMENTS

| | | | |
|---|---|---|---|
| 662700 | 12/1951 | United Kingdom | 446/353 |

*Primary Examiner*—Mickey Yu

*Attorney, Agent, or Firm*—John S. Pacocha

[57] ABSTRACT

A pop-up crib toy including a head mounted on a rod with a cylindrical gear rack. The rod is slidably carried in a tube included in a housing for a motor driven gear segment. Engagement of the teeth on the gear segment with the cylindrical rack drives the head up from the housing in opposition to a gravity bias which lowers the head upon disengagement of the gear segment teeth from the rack teeth. In the wall of the tube a serpentine slot is provided in which a pin carried by the rod rides to turn the head from side to side as it moves up and down. L-shaped paws extending from the housing hang the character over the edge of a crib.

14 Claims, 6 Drawing Figures

POP-UP CRIB TOY

This is a continuation of co-pending application Ser. No. 685,983 filed Dec. 24, 1984, now abandoned.

BACKGROUND OF THE INVENTION

1. Field of the Invention

This invention relates generally to motor driven toys and more particularly to an infants' pop-up crib toy.

2. Background Art

Motor operated crib toys that provide entertaining action for infants are old in the art. For example, U.S. Pat. Nos. 4,285,159 and 4,449,321 disclose toys which move back and forth on a crib rail while U.S. Pat. No. 4,453,339 discloses a toy that rocks a musical horse atop the crib rail In U.S. Pat. No. 4,391,061, a acrobatic rotating toy that is hung from the sides of a crib is disclosed. However, there remains a need for additional crib toys with entertaining actions.

SUMMARY OF THE INVENTION

The present invention is concerned with providing a motor driven infants' pop-up crib toy that provides an entertaining action. This and other objects and advantages of the invention are achieved by a character attachable to the outside of a crib and having a motor driving a gear segment to periodically raise a downwardly biased cylindrical rack on top of which is mounted the head of the character. The cylindrical rack is received for movement in a tube having a serpentine slot in which a pin carried by the rack rides to twist and turn the character's head as it is raised.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
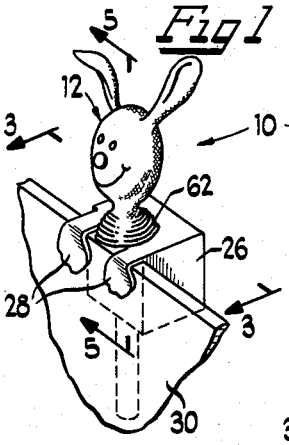
FIG. 1 is perspective view of an embodiment of the present invention.
Figure 2:
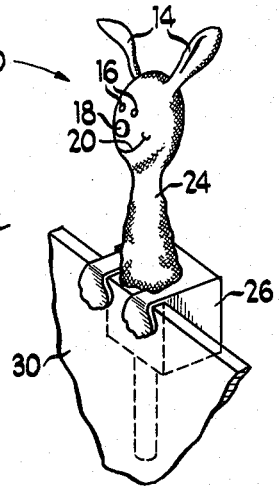
FIG. 2 is a perspective view of the embodiment in its upraised position.

Referring now to the drawing in which like parts are designated by like reference numerals throughout the several views, there is shown in FIG. 1 a toy character 10 including a head 12 with ears 14, eyes 16, nose 18 and mouth 20. The head is supported by an underlying skull 22 over which is a covering 24 that may be a plush material or some other fabric or flexible material. Character 10 includes a box-like torso 26 with laterally extending L-shaped paws 28 that fit over the upper edge of part of a crib 30. Thus, toy character 10 may be hung over the top of the crib rail or a crib headboard or footboard as is illustrated in FIGS. 1 and 2.

Within the torso housing 26, there is a support wall 32 on one side of which are mounted batteries 33. Spaced from the support wall 32 within the housing is a three-walled support bracket 34 that carries the battery powered motor 36. Also supported on the bracket 34 are a belt-drive 38 transmitting power from the motor to a speed reducing gear train 40. An on-off switch 42 for the motor is provided on the outside of the box-like torso housing 26. Mounted on the same shaft 44, which is journaled between one of the walls of the bracket 34 and the support wall 32, for rotation with the last gear 46 of the speed-reducing gear train is a gear segment 48. The segment has an approximately 270 degree section of teeth 50 and an approximately 90 degree notch 52.

In addition to the batteries, motor and drive mechanism for gear segment 48, the housing 26 includes an elongated tubular sleeve 54. The longitudinal axis of tube 54 is generally transverse to the axis of the shaft 44 upon which gear segment 48 rotates. Carried for reciprocal motion generally along the longitudinal axis of the tube 54 is a rod 56 whose lower portion includes a cylindrical gear rack 58. An upper portion of the rod 56 that projects above the tube 54 has the skull 22 attached.

Figure 5:
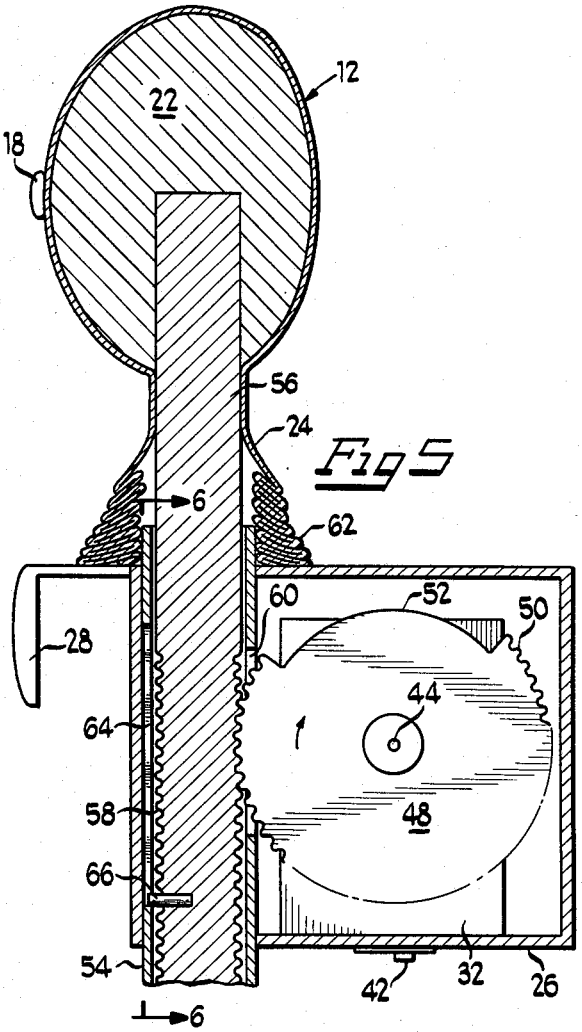
FIG. 5 is sectional view taken generally along the line 5—5 of FIG. 1.
Figure 3:
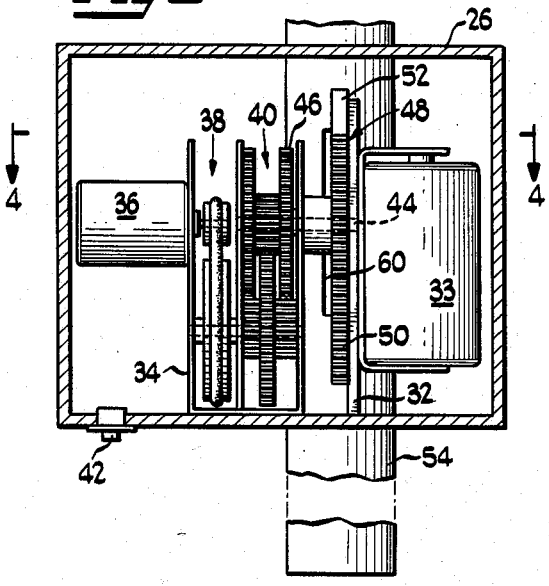
FIG. 3 is an enlarged scale sectional view taken generally along the line 3—3 of FIG. 1.
Figure 4:
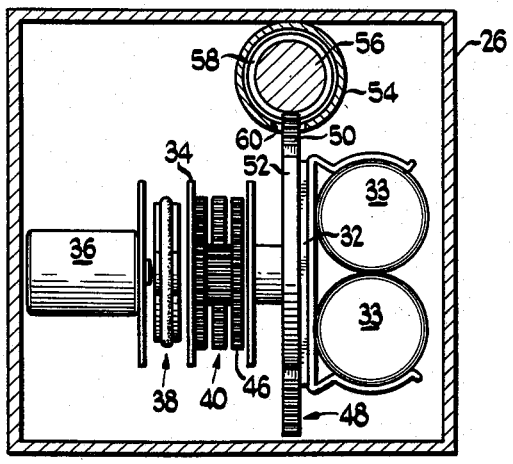
FIG. 4 is a sectional view taken generally along the line 4—4 of FIG. 3.
Figure 6:
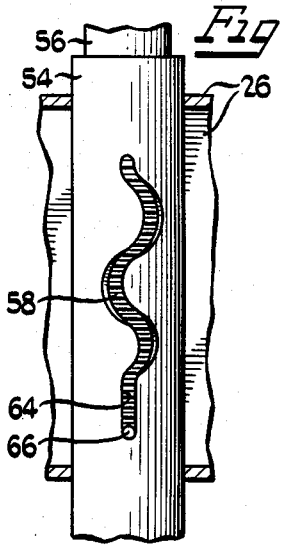
FIG. 6 is a fragmentary sectional view taken generally along the line 6—6 of FIG. 5.

Part of the covering 24 depends down from the head 12 and, as illustrated in FIGS. 1 and 5 lies in folds 62 over the rod 56, tube 54 and the immediate surrounding portion of the torso housing 26 when the head is in a lowered position. As shown in this embodiment, a single covering 24 is used for the head and the depending portion. However, if desired, a different covering could be used, or the head 12 could be formed of vinyl or some other material not needing a separate skull and covering. In such an alternative, a covering representing skin, fur or clothing would be attached to the character immediately below the head.

A slit 60 in the back of the tube 54 permits the teeth 50 of the gear segment 48 to engage the cylindrical rack 58. When gear segment 48 is driven by motor 36 in the clockwise direction illustrated in FIG. 5, the engagement between segment teeth 50 and the rack 58 drives the rod 56 up within the tube 54 to raise the head 12 of the character. As head 12 rises up to the position illustrated in FIG. 2, the additional part of covering 24 provided in folds 62 is used to obscure the projecting length of rod 56. It is also possible to use a fabric with sufficient inherent elasticity to provide the amount of expansion necessary to accommodate the upward movement of the head and thus avoid folds 62.

When the notch 52 of the gear segment 48 rotates around to where the notch would be tangent to the cylindrical rack 58 and the last of the teeth 50 rotate out of engagement with the rack, head 12 and rod 56, which are biased downwardly by gravity, drop back down to the position illustrated in FIGS. 1 and 5. If gravity does not provide a sufficient bias because of the materials used for head 12 or rod 56, or if a greater resistance of covering 24 must be overcome, an additional biasing force such as a spring (not shown) or an elastic band (not shown) may be used. Upon the first tooth immediately counterclockwise of the notch 52 again engaging the teeth of the cylindrical rack 58, head 12 is again driven back against the bias up to the position shown in FIG. 2.

To add further interest to the up and down peek-a-boo movement of toy character 10, the wall of tube 54 is provided with a serpentine slot 64. A guide pin 66 carried by the rod 56, or more particularly by the cylindrical rack portion 58, rides in the slot 64. Thus, as the rod 56 and head 12 are driven upwardly by the engagement of the gear segment teeth 50 and the cylindrical rack 58, pin 66 engaging the sides of the serpentine slot 64 causing head 12 to rotate from side to side as the head rises.

While a particular embodiment of the present invention is shown and described with some changes and modifications, additional changes and modifications will occur to those skilled in the art. It is intended in the appended claims to cover all such changes and modifications as fall within the true spirit and scope of the present invention.

What is claimed as new and desired to be secured by Letters Patent is:

1. A pop-up character toy comprising:
a housing containing a motor;
a moveable rod with an axis carried by the housing with one end of the rod extending above the housing;
a head for the character mounted on the one end of the rod;
drive means between the motor and the rod periodically driving the head up away from the housing and simultaneously turning the head relative to the axis of the rod during a first predetermined interval and returning the head back toward the housing during a second predetermined interval that is shorter than the first predetermined interval;
the drive means including a gear segment drivingly connected to the motor for rotation;
the gear segment having a first section of teeth that is less than 360 degrees and a second section without teeth;
the rod including a gear rack having teeth;
engagement between the teeth of the gear segment and the teeth of the rack driving the head up away from the housing as the motor rotates the gear segment; and
means biasing the head back toward the housing when the teeth of the gear segment rotate out of engagement with the teeth of the rack.

2. The toy of claim 1 in which:
the rod includes a generally cylindrical portion;
a tubular sleeve carried by the housing receives the generally cylindrical portion;
a serpentine slot is in the wall of the tubular sleeve; and
a pin carried by the generally cylindrical portion rides in the slot.

3. The toy of claim 2 including means extending from the housing for hanging the toy on a crib.

4. The toy of claim 2 including a flexible covering depending from the head down to obscure the rod.

5. The toy of claim 1 in which:
the gear rack is cylindrical;
a tubular sleeve carried by the housing receives the gear rack;
a serpentine slit is in the wall of the tubular sleeve; and
a pin carried by the cylindrical rack rides in the slot.

6. The toy of claim 5 including means extending from the housing for hanging the toy on a crib.

7. The toy of claim 5 including a flexible covering depending from the head down to obscure the rod.

8. The toy of claim 1 in which the first section is approximately 270 degrees and the second section is approximately 90 degrees.

9. A pop-up character toy comprising:
a housing containing a motor;
a gear segment drivingly connected to the motor for rotation;
a cylindrical rod carried by the housing;
the cylindrical rod including a cylindrical gear rack having teeth;
a head for the character mounted on one end of the rod;
engagement between the teeth of the gear segment and the teeth of the cylindrical rack during a first predetermined interval moving the head of the character away from the housing when the motor rotates the gear segment;
a tubular sleeve carried by the housing receiving the cylindrical rod and gear rack;
a serpentine slot in the wall of the tubular sleeve;
a pin carried by the rod riding in the slot; and
means biasing the head back toward the housing during a second predetermined interval that is shorter than the first predetermined interval.

10. The toy of claim 9 including means extending from the housing for hanging the toy on a crib.

11. The toy of claim 9 including a flexible covering depending from the head down to obscure the rod.

12. A pop-up character toy comprising:
a housing containing a motor;
a gear segment drivingly connected to the motor for rotation;
a rod carried by the housing;
the rod including a generally cylindrical portion and a gear rack having teeth;
a head for the character mounted on one end of the rod;
engagement between the teeth of the gear segment and the teeth of the cylindrical rack during a first predetermined interval moving the head of the character away from the housing when the motor rotates the gear segment;
a tubular sleeve carried by the housing receiving the generally cylindrical portion of the rod;
a serpentine slot in the wall of the tubular sleeve;
a pin carried by the generally cylindrical portion of the rod riding in the slot; and
means biasing the head back toward the housing during a second predetermined interval that is shorter than the first predetermined interval.

13. The toy of claim 12 including means extending from the housing for hanging the toy on a crib.

14. The toy of claim 12 including a flexible covering depending from the head down to obscure the rod.

* * * * *